US008026783B2

(12) United States Patent
Skinner et al.

(10) Patent No.: US 8,026,783 B2
(45) Date of Patent: Sep. 27, 2011

(54) IGNITION COIL FOR VEHICLE

(75) Inventors: Albert A. Skinner, El Paso, TX (US); Harry O. Levers, Jr., El Paso, TX (US); John D. Truong, Mooresville, IN (US)

(73) Assignee: Delphi Technologies, Inc., Troy, MI (US)

( * ) Notice: Subject to any disclaimer, the term of this patent is extended or adjusted under 35 U.S.C. 154(b) by 109 days.

(21) Appl. No.: 12/555,437

(22) Filed: Sep. 8, 2009

(65) Prior Publication Data

US 2011/0057757 A1 Mar. 10, 2011

(51) Int. Cl.
*H01F 27/02* (2006.01)

(52) U.S. Cl. ..... 336/90; 336/96; 336/198; 123/634

(58) Field of Classification Search ..... 336/90, 336/96, 198; 123/634
See application file for complete search history.

(56) References Cited

U.S. PATENT DOCUMENTS

| | | | | |
|---|---|---|---|---|
| 2,107,973 | A * | 2/1938 | Bajon | 336/70 |
| 3,437,966 | A * | 4/1969 | Tolley | 336/90 |
| 4,580,122 | A * | 4/1986 | Worz | 336/96 |
| 4,893,105 | A * | 1/1990 | Maeda et al. | 336/84 M |
| 5,632,259 | A * | 5/1997 | Konda et al. | 123/634 |
| 6,011,457 | A * | 1/2000 | Sakamaki et al. | 336/96 |
| 6,308,696 | B1 * | 10/2001 | Kondo et al. | 123/634 |
| 6,794,974 | B2 * | 9/2004 | Widiger et al. | 336/90 |
| 7,132,919 | B2 * | 11/2006 | Neumann et al. | 336/192 |
| 7,239,224 | B2 * | 7/2007 | Wada | 336/90 |

* cited by examiner

*Primary Examiner* — Anh Mai
*Assistant Examiner* — Joselito Baisa
(74) *Attorney, Agent, or Firm* — Thomas N. Twomey

(57) ABSTRACT

A spark plug coil assembly includes a primary core inside a secondary winding spool that is formed with a closed end. A terminal is embedded in the closed end of the spool and the secondary windings are terminated to the terminal, with the terminal being couplable to a spark plug. Ignition voltage generated in the secondary windings is thus routed to a center of the secondary windings to terminate at the terminal. No pole piece need be disposed between the primary core and the closed end of the spool.

16 Claims, 3 Drawing Sheets

IGNITION COIL FOR VEHICLE

FIELD OF THE INVENTION

The present invention relates generally to vehicle ignition coils.

BACKGROUND OF THE INVENTION

Ignition coils are components that use the coupling between a primary winding and a secondary winding to transform relatively low voltages from the battery into high voltages that are supplied to the spark plugs in vehicle gasoline engines. The spark plugs start the internal combustion process that drives the rods and hence, crankshaft and axles. In older systems, a single ignition coil is provided, and a distributor sends the pulses from the coil through respective high voltage spark plug wires to the spark plugs in the cylinders in accordance with a timing that is established by the distributor.

In relatively modern engines, an engine can have several ignition coils, one for each cylinder or for each pair of cylinders, thereby advantageously eliminating the need for distributors and high voltage wires and also providing more precise control of the engine timing. One example of such an ignition coil system is set forth in U.S. Pat. No. 6,556,118, owned by the present assignee and incorporated herein by reference.

Ignition coils have been made in a so-called "plug top coil" (PTC) configuration in which the coil is mounted above the spark plug well. As recognized herein, it is sometimes required that the axis of the coil be centered over the plug well, requiring in turn the high voltage to be routed around a pole piece of the primary coil core. The high voltage wire typically is protected from the pole piece by a separate plastic component that also is designed to reduce the strain between epoxy encapsulate in the coil assembly and the pole piece.

SUMMARY OF THE INVENTION

A spark plug coil assembly includes a primary core bearing primary windings and a secondary winding spool around which secondary windings are wound. The primary core is received in the spool through an open end of the spool. The spool is formed with a closed end opposite the open end, and a terminal is embedded in the closed end of the spool. The terminal is electrically connected to the secondary windings and can be coupled to a spark plug by coupling components. Ignition voltage generated in the secondary windings is thus routed to a center of the secondary windings to terminate at the terminal.

In some embodiments no pole piece need be disposed between the primary core and the closed end of the spool. In example embodiments the core is a laminated core and a flux director is disposed around the core.

A cup can abut the terminal and can be electrically connected to a spark plug by, e.g., a spring. The secondary windings may be segment wound around the spool or they may be progressively wound around the spool.

In example embodiments a case typically holds the spool and a magnetic shield typically surrounds the case, and in some implementations the case and shield are frusto-conical in shape. The shield can be formed with a curve curving inwardly to wrap around an end of the case, increasing magnetic coupling between the shield and the primary core.

In another aspect, a spark plug coil assembly includes a primary core bearing primary windings and a secondary winding spool around which secondary windings are wound.

The primary core is received in the spool through an open end of the spool. The spool is formed with a closed end opposite the open end. A terminal is embedded in the closed end of the spool and is electrically connected to the secondary windings. No pole piece is disposed between the primary core and the closed end of the spool.

In another aspect, a method includes advancing a first end of a primary winding core into a hollow secondary winding spool until the first end is juxtaposed with a closed end of the spool. The method includes providing a secondary winding terminal centrally in the closed end of the spool to center, relative to the spool, voltage induced in secondary windings that are disposable around the spool. The voltage is induced when windings wound around the core are energized. The secondary terminal is electrically connectable to a spark plug to provide ignition energy thereto.

The details of the present invention, both as to its structure and operation, can best be understood in reference to the accompanying drawings, in which like reference numerals refer to like parts, and in which:

DETAILED DESCRIPTION OF THE PREFERRED EMBODIMENT

Figure 1:
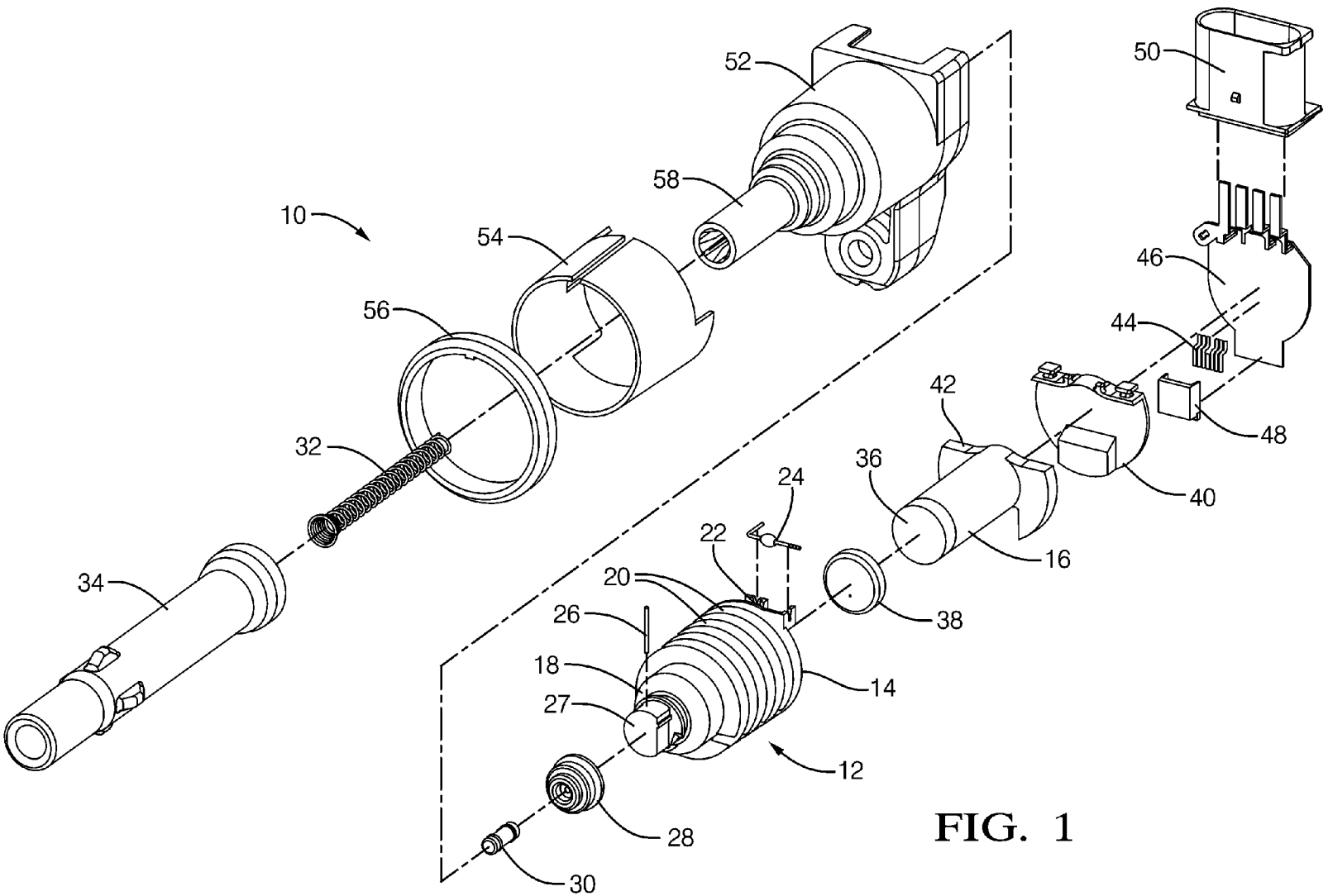
FIG. 1 is a an exploded perspective view of an example ignition coil, with the windings removed for clarity.
Figure 2:
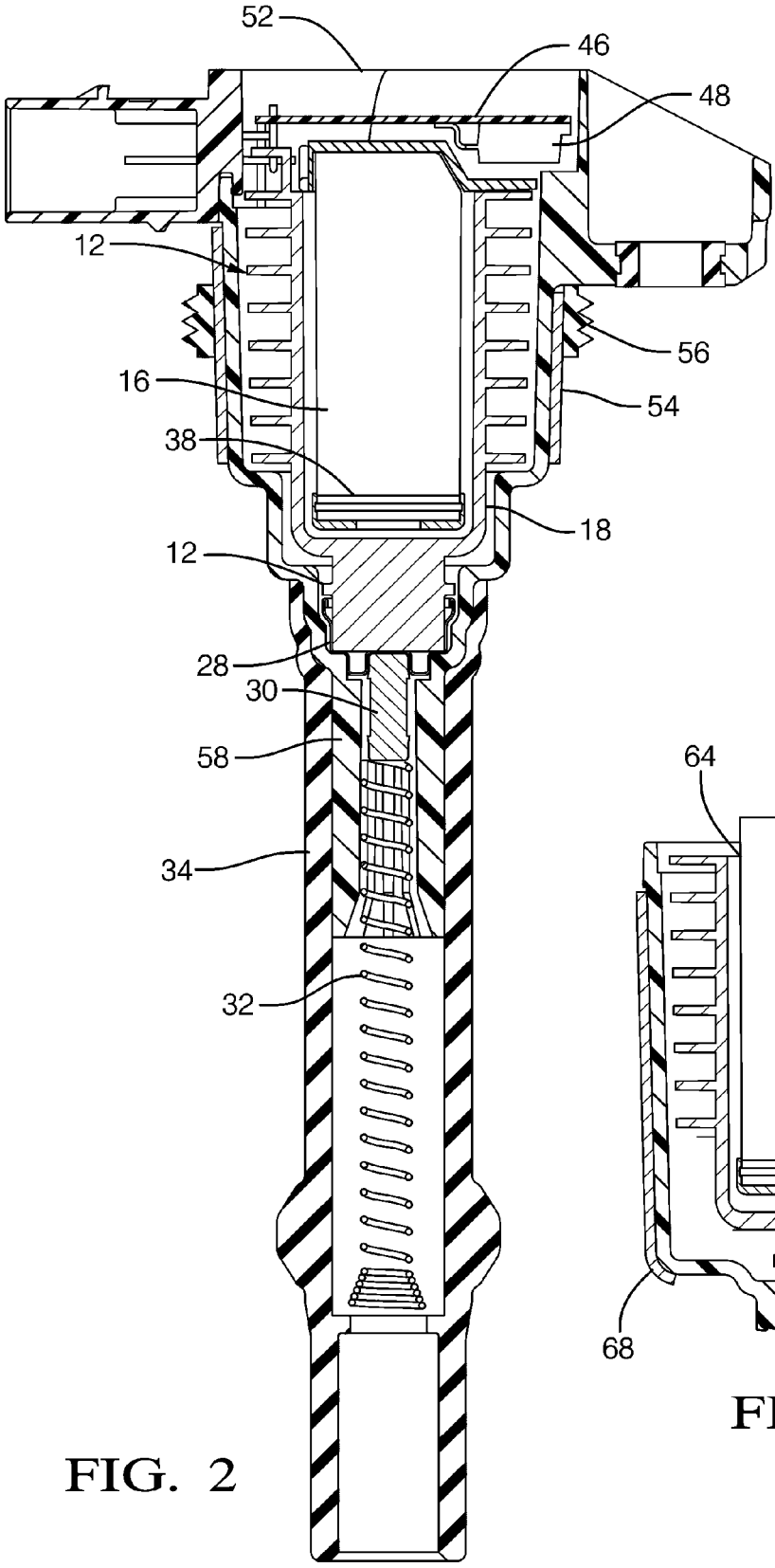
FIG. 2 is a cut-away side elevational view of the coil shown in FIG. 1.

Referring initially to FIGS. 1 and 2, a spark plug coil assembly is shown, generally designated 10, which includes an electrically insulated hollow secondary winding spool 12 having an open end 14 for received a primary winding core 16 therein and an opposed closed end 18. As shown in FIG. 2, the closed distal end 18 may be solid.

In some embodiments the spool 12 may be formed with plural radial ring-shaped ribs 20 for segment winding of the secondary coil. In other embodiments the secondary coil may be progressively wound on the spool 12. In any case, near its open end 14 the spool 12 may be formed with a terminal support 22 that supports a first electrically conductive secondary winding terminal 24. A second electrically conductive secondary winding terminal 26 may be disposed in the spool 12 near the closed end 18 as shown, with the secondary windings connecting the terminals 24, 26. In specific embodiments the second (lower) terminal 26 may be established by a wire with a rectilinear cross-section that is pressed through a solid boss 27 that is an integral part of the spool 12.

A terminal cup 28 that may be made of, e.g., aluminum covers the closed end 18 of the spool 12 and is in electrical contact with the second terminal 26 using, in example non-limiting embodiments, the technique described in U.S. Pat. No. 6,522,232, incorporated herein by reference. The terminal cup 28 establishes electrical connectivity between the secondary winding terminal 26 and a radiofrequency interference (RFI) resistor 30. In turn, in example embodiments the RFI resistor 30 contacts a spring 32 that is configured to engage the end of a spark plug (not shown) that may be held within a typically rubber or plastic boot 34. In this way, the secondary windings of the assembly 10 are electrically connected to the spark plug through the embedded secondary winding terminal 26 in the closed distal end 18 of the secondary winding spool 12.

Returning to the primary core 16, it is to be understood that the primary core 16 bears primary windings (not shown) that can receive signals from circuitry described further below. In the embodiment shown in FIGS. 1 and 2 the primary core 16 is made of composite Iron, and when it is so made, no flux director need be provided on the end 36 of the primary core 16 that slides into the secondary spool 12 and that is juxtaposed with the closed end 18 thereof. If desired, a disk-shaped rubber buffer cap can be disposed between the end 36 of the primary core 16 and the inside surface of the closed end 18 of the spool 12 to accommodate thermal expansion differentials between the core 16 and epoxy that may be used to fill the spool 12 after the core 16 is disposed therein.

An electronics support 40 may be provided on the end 42 of the primary core 16 that is opposite to the end 36 of the core which is advanced first into the spool 12. The support 40 may bear a lead frame 44 holding a circuit board 46 with associated integrated circuit 48 for controlling the primary windings. A hollow plastic connector body 50 may be provided for covering an external electrical terminal to the electronics.

The spool 12 with secondary windings on its outside and the primary core 16 with primary windings inside may be held by a hollow case 52 that may be filled of mica/glass and that may be made of polyethylene terephthalate (PET). A cylindrical magnetic shield 54 can closely surround the case 52 as shown for providing a magnetic return path in accordance with spark plug coil principles known in the art, and a resilient rubber or plastic seal 56 can surround the shield 54 to engage engine structure above the spark plug well. It can best be appreciated in FIG. 2 that the boot 34 closely fits over a narrow lower end 58 of the case 52.

With the above structure in mind, it may now be appreciated that with the elimination of a pole piece between the primary core 16 and the closed bottom end 18 of the secondary winding spool 12, the high ignition voltage generated in the secondary windings can be routed to the center of the secondary windings to terminate at the second (lower) terminal 26, advantageously avoiding the necessity of routing the high voltage around the (now eliminated) pole piece and also eliminating the plastic protective component discussed above.

Figure 3:
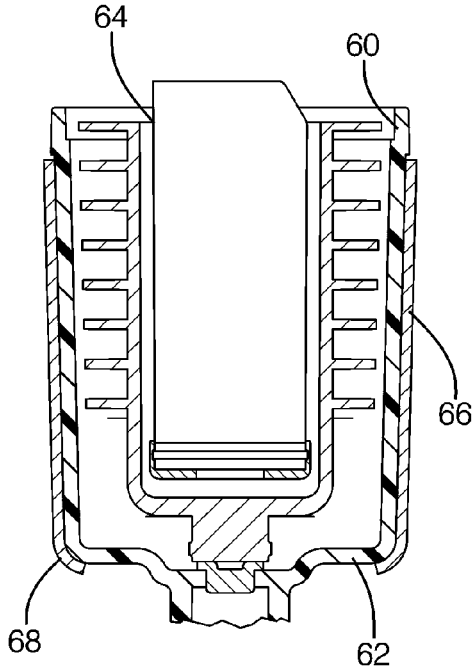
FIG. 3 is a side view of another example assembly, with some components omitted for clarity.

In the embodiment shown in FIGS. 1 and 2, the case 52 and shield 54 are cylindrical. As understood herein, with the elimination of the lower pole piece, the coupling between the primary core 16 and magnetic shield can be reduced. Accordingly, as shown in FIG. 3, to counteract the reduced coupling in some implementations an alternate case 60 may be frusto-conical in shape, tapering inwardly toward its distal end 62. A secondary winding spool 64 with the attendant primary core and windings can be contained in the case 60 in accordance with principles discussed above. A frusto-conical magnetic shield 66 surrounds the case 60, tapering inwardly to an open distal end that may be have a curve 68. The portions of the shield 66 above the curve 68, being frusto-conical, are straight in the axial dimension (albeit canted) from top to bottom, whereas the curve 68 is curved inwardly in the axial dimension from top to bottom and thus is more steeply angled inwardly than the taper of the remainder of the shield 66 to wrap around the end 62 of the case 60, increasing the magnetic coupling between the shield 66 and the primary core.

Figure 4:
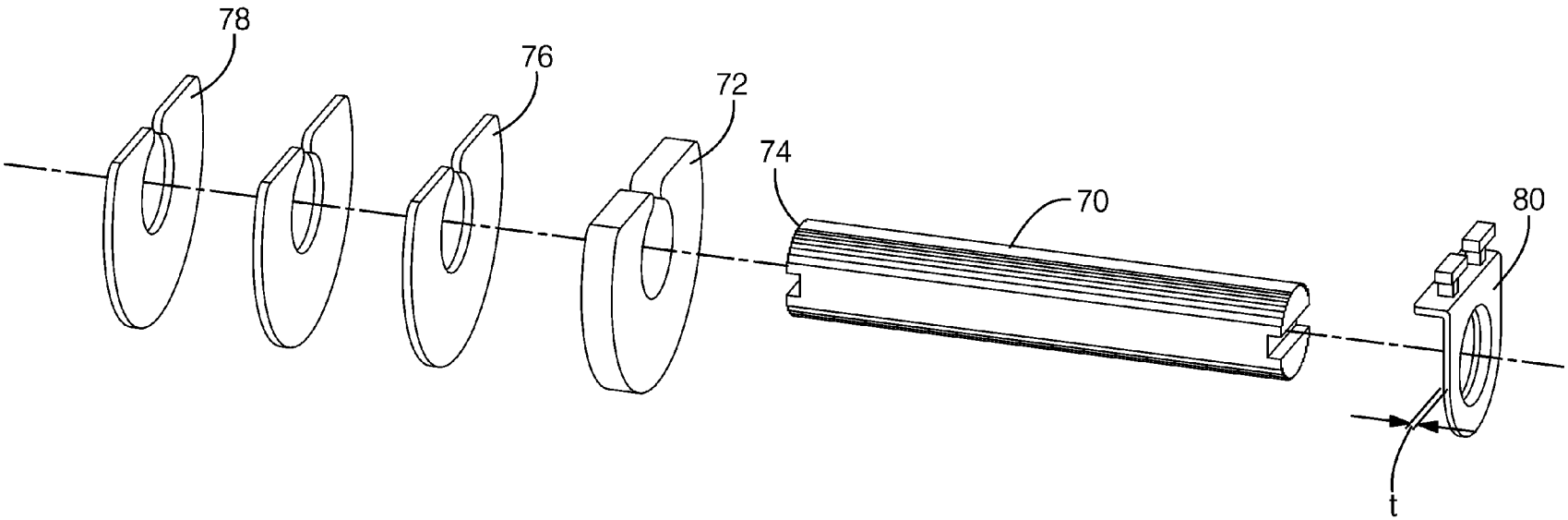
FIG. 4 is an exploded perspective view of an alternate primary winding core that may be used.

Alternatively to a primary core made of composite Iron, FIG. 4 shows that a laminated primary core 70 may be used. In contrast to the core 16 described above, such a core 70 may be associated with a hollow U-shaped flux director 72 that surrounds the end 74 of the primary core 70 that faces the closed end of the spool. Additional hollow U-shaped laminations 76 may be provided in layers against the flux director 72 if needed for increased energy levels. Small dimples 78 may be provided on the periphery of an additional lamination 76 for being pressed into the flux director. Opposite the flux director 72 a wire support 80 with a thickness "t" of, e.g., a half millimeter may be provided on the primary core 70. The alternate structure shown in FIG. 4 is further described in U.S. patent application Ser. No. 12/069,339, incorporated herein by reference.

While the particular IGNITION COIL FOR VEHICLE is herein shown and described in detail, it is to be understood that the subject matter which is encompassed by the present invention is limited only by the claims.

What is claimed is:

1. Spark plug coil assembly comprising:

a primary core bearing primary windings;

a secondary winding spool around which secondary windings are wound, the primary core being received in the spool through an open end of the spool, the spool being formed with a closed end opposite the open end, wherein no pole piece is disposed between the primary core and the closed end of the spool;

a terminal embedded in the closed end of the spool and electrically connected to the secondary windings, the terminal being electrically couplable to a spark plug by coupling components, wherein ignition voltage generated in the secondary windings is routed to a center of the secondary windings to terminate at the terminal;

a case holding the spool, wherein the case is frusto-conical in shape; and a magnetic shield at least partially surrounding the case, wherein the magnetic shield is frusto-conical in shape for increasing magnetic coupling between the magnetic shield and the primary core, wherein the magnetic shield surrounds the secondary windings.

2. The assembly of claim 1, comprising a cup abutting the terminal and electrically connected to a spark plug.

3. The assembly of claim 1, wherein the core is a laminated core and a flux director is disposed around the core.

4. The assembly of claim 1, wherein the secondary windings are segment wound around the spool.

5. The assembly of claim 1, wherein the secondary windings are progressively wound around the spool.

6. The assembly of claim 1, wherein the shield is formed with a curve curving inwardly to wrap around an end of the case, increasing magnetic coupling between the shield and the primary core.

7. A spark plug coil assembly, comprising:

a primary core bearing primary windings;

a secondary winding spool around which secondary windings are wound, the primary core being received in the spool through an open end of the spool, the spool being formed with a closed end opposite the open end;

a terminal embedded in the closed end of the spool and electrically connected to the secondary windings, wherein no pole piece is disposed between the primary core and the closed end of the spool;

a case holding the spool, wherein the case is frusto-conical in shape; and a magnetic shield at least partially surrounding the case, wherein the magnetic shield is frusto-conical in shape for increasing magnetic coupling between the magnetic shield and the primary core, wherein the magnetic shield surrounds the secondary windings.

8. The assembly of claim 7, comprising a cup abutting the terminal and electrically connected to a spark plug.

9. The assembly of claim 7, wherein the core is a composite Iron core.

10. The assembly of claim 7, wherein the secondary windings are segment wound around the spool.

11. The assembly of claim 7, wherein the secondary windings are progressively wound around the spool.

12. The assembly of claim 7, wherein the shield is formed with a curve curving inwardly to wrap around an end of the case, increasing magnetic coupling between the shield and the primary core.

13. Method comprising:

advancing a first end of a primary winding core into a hollow secondary winding spool until the first end is juxtaposed with a closed end of the spool;

providing a secondary winding terminal centrally in the closed end of the spool to center, relative to the spool, voltage induced in secondary windings that are disposable around the spool, the voltage being induced when windings wound around the core are energized, the secondary terminal being electrically connectable to a spark plug to provide ignition energy thereto;

disposing the spool within a case, wherein the case is frusto-conical in shape; and disposing a magnetic shield at least partially around the case, wherein the magnetic shield is frusto-conical in shape for increasing magnetic coupling between the magnetic shield and the primary core, wherein the magnetic shield surrounds the secondary windings.

14. The method of claim 13, wherein no pole piece is disposed between the primary winding core and the closed end of the spool.

15. The method of claim 13, wherein the core is a laminated core and the method includes providing a flux director around the core.

16. The method of claim 13, wherein the shield is formed with a curve curving inwardly to wrap around an end of the case, increasing magnetic coupling between the shield and the primary core.

* * * * *